US006516162B2

(12) United States Patent
Ino et al.

(10) Patent No.: US 6,516,162 B2
(45) Date of Patent: Feb. 4, 2003

(54) IMAGE FORMING APPARATUS WITH AUTOMATIC DENSITY COMPENSATION

(75) Inventors: Toshiaki Ino, Yamatokoriyama (JP); Hiroshi Kawamoto, Tenri (JP); Masayasu Narimatsu, Nara (JP); Takashi Kitagawa, Yamatokoriyama (JP); Ken Yamagishi, Yamatotakada (JP); Yuka Sakagami, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/839,835

(22) Filed: Apr. 20, 2001

(65) Prior Publication Data

US 2001/0033755 A1 Oct. 25, 2001

(30) Foreign Application Priority Data

Apr. 21, 2000 (JP) ..... 2000-121586

(51) Int. Cl.[7] ..... G03G 15/00
(52) U.S. Cl. ..... 399/49; 347/251
(58) Field of Search ..... 399/49, 46, 72, 399/181; 347/251; 358/298

(56) References Cited

U.S. PATENT DOCUMENTS 5,351,107 A * 9/1994 Nakane et al. ..... 399/72
5,410,388 A * 4/1995 Pacer et al. ..... 399/49
5,481,337 A * 1/1996 Tsuchiya et al. ..... 399/46
5,574,543 A * 11/1996 Sakai et al.
5,729,786 A * 3/1998 Yamada et al. ..... 399/42
5,754,920 A * 5/1998 Tanaka et al. ..... 399/49
5,940,654 A * 8/1999 Uchiyama et al. ..... 399/49
5,995,248 A * 11/1999 Katori et al.
6,035,103 A * 3/2000 Zuber ..... 399/49
6,185,386 B1 * 2/2001 Noguchi ..... 399/49

FOREIGN PATENT DOCUMENTS

| | | |
|---|---|---|
| JP | 5-281790 | 10/1993 |
| JP | 6-87234 | 3/1994 |
| JP | 10-65920 | 3/1998 |

* cited by examiner

*Primary Examiner*—Susan S. Y. Lee
(74) *Attorney, Agent, or Firm*—Dike, Bronstein, Roberts & Cushman; David G. Conlin

(57) ABSTRACT

The object of this invention is to provide an image forming apparatus capable of preventing decrease in image density at a rear end part of an image. A change in waveform in sensor outputs which is produced when a toner patch image is read by an optical sensor used for the process control is detected. The difference (Vg−Vd) between grid voltage Vg and development bias voltage Vd is changed only between a target value of 300 V corresponding to low-output side threshold value Va and a target value of 100 V corresponding to high-output side threshold value Vb according to the sensor output deflection ΔV so that the difference (Vg−Vd) decreases as the image loss level increases. The difference between the grid voltage Vg and the development bias voltage Vd is set so as to prevent the image loss in the rear end part of an image.

10 Claims, 11 Drawing Sheets

IMAGE FORMING APPARATUS WITH AUTOMATIC DENSITY COMPENSATION

BACKGROUND OF THE INVENTION

1. Field of the Invention

The present invention relates to an image forming apparatus such as copying machines, printers and facsimiles, in which image formation is carried out in an electrophotographic process.

2. Description of the Related Art

Some image forming apparatuses based on the electrophotographic process use a two-component magnetic brush phenomenon method, the development method for making an electrostatic latent image on a photosensitive body visible, in which a two-component developer including an insulating toner and magnetic carriers is mixed and agitated and in which the magnetic carriers electrostatically attracting the insulating toner are magnetically attracted in the form of brush to a circumferential surface of a development roller by magnetic forces from magnetic poles in the development roller so that the developer carried on the development roller is transferred onto a surface of the photosensitive body as the development roller rotates. This method is widely employed particularly in a color image forming system that produces one color image through a plurality of electrophotographic processes using different color toners.

In the image forming based on the electrophotographic process using the two-component magnetic brush phenomenon method, however, when there are two continuous image areas in an image that have different densities, a phenomenon may occur in which an image density of one image area at the boundary with the other image area decreases.

For example, as shown in FIG. 13A, when an image changes from a half-tone area G1 to a background area G2 in a sub-scan direction Y (opposite the paper feed direction) perpendicular to the main scan direction X of an exposure beam for forming an electrostatic latent image on the surface of the photosensitive body, a sub-scan direction rear end part G1*a* of the half-tone area G1 which adjoins the half-tone area G2 may decrease in density. Further, as shown in FIG. 13B, when an image changes from a low-density area G3 to a high-density area G4 in a sub-scan direction Y, a sub-scan direction rear end part G3*a* of the low-density area G3 adjoining the high-density area G4 may decrease in density.

First, the density reduction in the rear end part of the half-tone area adjoining the background area is explained with reference to FIGS. 14A and 14B. FIG. 14A shows a front edge part of a latent image of the half-tone area formed on the photosensitive body in contact with a developer layer. FIG. 14B shows a rear end part of the latent image of the half-tone area in contact with the developer layer. To a development roller 102 is applied a development bias (e.g., −500V). The surface of a photosensitive drum 101 is charged by a charger 103 to a bias (e.g., −650V) higher in absolute value than the development bias. The potential of the latent image S1 of the half-tone area is changed to a potential (e.g., −200V) lower in absolute value than the development bias by an exposure beam L.

As shown in FIG. 14A, when the front edge part S1*a* of the latent image S1 contacts the developer layer 104 formed over the circumferential surface of the development roller 102, a forward development electric field acts on the toner tq present at a contact position Q between the surface of the photosensitive drum 101 and the developer layer 104, which toner tq is attracted to the surface of the developer layer and then to the surface of the photosensitive drum 101. When as shown in FIG. 14B the rear end part of the latent image S1 contacts the developer layer 104, a latent image S2 of the background area comes near the developer layer 104, with the result that a reverse development electric field which repels the toner tb away from the surface of the developer layer 104 down toward the circumferential surface of the development roller 102 acts on the toner tb present at a position in the developer layer 104 facing the rear edge part S1*b* of the latent image S1.

The toner tb submerged toward the circumferential surface of the development roller 102 moves toward the surface of the developer layer 104 as the contact position Q approaches as a result of rotation of the development roller 102, but there is a time delay before it reaches the surface of the developer layer 104. Hence, the rear end part of the latent image S1 of the half-ton area that adjoins the latent image S2 of the background area is not attached with a sufficient amount of toner, resulting in a reduced image density at the rear end part of the half-tone area in the image.

In a case where there is a latent image S2 of the background area in front of the latent image S1 of the half-tone area as shown in FIG. 14A, when the front edge part S1*a* of the latent image S1 of the half-tone area is situated at the contact position Q, the toner tf that is repelled from the surface of the developer layer 104 by the latent image S2 of the background area at the front exists in the developer layer 104. However, as the development roller 102 rotates, the toner tf moves away from the contact position Q and the toner tq that is attracted to the surface of the developer layer 104 by the low potential of the latent image S1 of the half-tone area immediately comes close to the contact position Q and adheres to the latent image S1. Therefore, the front end part of the half-tone area adjoining the background area in the image does not produce a reduction in the image density.

Next, the density reduction in the rear end part of a low-density area adjoining a high-density area will be explained by referring to FIGS. 15A–15C. FIG. 15A shows a front edge part of a latent image of the low-density area formed over the photosensitive body in contact with the developer layer. FIG. 15B shows a rear end part of the latent image of the low-density area in contact with the developer layer. FIG. 15C shows a latent image of a high-density area situated behind the latent image of the low-density area in contact with the developer layer. To the development roller 102 is applied a development bias (e.g., −500V). The surface of the photosensitive drum 101 is charged by the charger 103 to a potential (e.g., −650V) higher in absolute value than the development bias. The potential of a latent image S3 of the low-density area is made lower in absolute value (e.g., −300V) than the development bias by an exposure beam L. The potential of a latent image S4 of the high-density area is made lower in absolute value (e.g., −200V) than that of the latent image S3 of the low-density area by the exposure beam L.

With the front edge part S3*a* of the latent image S3 of the low-density area in contact with the developer layer 104 of the development roller 102 as shown in FIG. 15A, the toner ta present at the contact position Q between the surface of the photosensitive drum 101 and a forward development electric field acts on the circumferential surface of the developer layer 104, which attracts the toner ta toward the surface of the development roller 102, allowing it to adhere to the surface of the development drum 101. Thus, the toner tc adheres to the entire surface of the latent image S3 of the low-density area formed over the surface of the photosensitive drum 101 as shown in FIG. 15B, until a rear edge part S3*b* of the latent image S3 of the low-density area reaches the contact position Q.

After this, when the latent image S4 of the high-density area located behind the latent image S3 of the low-density area comes to the contact position Q and begins to contact the developer layer 104, as shown in FIG. 15C, a stronger development electric field is produced in the forward direction between the latent image S4 and the developer layer 104 than that between the latent image S3 and the developer layer 104 because the potential of the latent image S4 is lower in absolute value than that of the latent image S3. This causes a larger amount of toner te to adhere to the latent image S4 than that of the latent image S3. Hence, at and around the position in the developer layer 104 facing the contact position Q, the carriers are deprived of most of the toner covering their surfaces, which are then exposed, with the result that the charged potential of the carriers attracts the toner tc from the rear end part of the latent image S3, to which once it has adhered, back to the developer layer 104. As a result, the rear end part of the latent image S3 of the low-density area adjoining the latent image S4 of the high-density area is not attached with a sufficient amount of toner, reducing the image density of the rear end part of the low-density area in the image.

As described above, the density reduction in the rear end part of the low-density area adjoining the high-density area is caused by a large amount of toner attaching to the latent image S4 of the high-density area immediately following the latent image S3 of the low-density area, followed by the toner, which has once attached to the latent image S3 of the low-density area, being drawn back to the developer layer 104 by the potential of the carriers in the developer layer 104 that have lost the toner. Hence, where a high-density area lies immediately before the low-density area, the front end part of the low-density area adjoining the high-density area does not undergo a reduction in the image density.

Such image density reductions in the rear end part of a half-tone area and in the rear end part of a low-density area are rather conspicuous in figure images formed by image generation apparatus such as personal computers which are increasing in numbers in recent years. In the image forming apparatus based on an electrophotographic system, particularly in printers connected to the image forming apparatus via network, there are stronger demands than in copying machines for preventing such image density reductions in the rear end part of a half-tone area and in the rear end part of a low-density area.

Thus, conventional image forming apparatus have provisions which, as disclosed in Japanese Unexamined Patent Publications JP-A 5-281790 (1993) and JP-A 6-87234 (1994) for example, increase the precision of a laser scan unit, which forms an electrostatic latent image on the surface of the photosensitive body, and adjust parameters of a development unit, which makes the electrostatic latent image visible, to enhance the contrast of the development electric field, thereby preventing the image density reductions in the rear end part of a half-tone area and in the rear end part of a low-density area.

The method of enhancing the contrast of the development electric field by increasing the precision of the laser scan unit, however, has a drawback of increasing the size and cost of the image forming apparatus. Further, when the number of scan lines in the sub-scan direction is to be increased for enhancement of the image resolution, the reduced contrast of the development electric field makes more conspicuous the image density reductions in the rear end part of the half-tone area adjoining the background area and in the rear end part of the low-density area adjoining the high-density area. It is therefore difficult to achieve both the image resolution enhancement and the prevention of partial image density reductions.

Further, because the image forming process based on the electrophotographic system has a variety of parameters of a plurality of units acting on one another in a complicated manner, it is very difficult to analyze the physical properties of the units and determine the parameters for preventing the image density reductions. Directly measuring the physical properties of the units by using measuring devices is not easy. Further, there are characteristic variations among different image forming apparatus due to individual differences. Characteristic variations of the units, which will cause image density reductions, are also produced by external environmental changes such as temperature and humidity and by progressive degradation over time of parts making up the apparatus. Considering these, it is all the more difficult to determine a unique set of characteristics capable of preventing the image density reductions.

In the arrangement disclosed in Japanese Unexamined Patent Publication JP-A 10-65920 (1998), therefore, the process for preventing image density reduction involves outputting measurement data consisting of an array of toner patches with different numbers of pixels to be corrected (ranges of a rear end part where a density reduction takes place) and different pixel-value correction amounts (correction amounts corresponding to the density reductions), determining from the output results an appropriate number of pixels to be corrected and an appropriate amount of pixel-value correction, storing them in a characteristic description means, extracting from input image data a rear edge area where a loss of image (a partial reduction in the image density) may occur, and correcting the image data in the extracted rear edge portion based on the number of pixels to be corrected and the amount of pixel-value correction, both held in the characteristic description means, thereby preventing image density reduction in that area.

In the arrangement disclosed in JP-A 10-65920, however, because the toner patches with a plurality of density levels (2–256 levels) are formed by the image output apparatus and the degree of the decrease in density in the rear end part of the image is calculated for each density level, the processing takes much time and a large amount of toner is required to form a plurality of toner patches.

SUMMARY OF THE INVENTION

An object of the invention is to provide an image forming apparatus which can easily determine characteristics which cause image density reductions without having to analyze physical properties of constitutional units making up the image forming apparatus and which can prevent image density reduction in a rear end part of a half-tone area adjoining a background area and in a rear end part of a low-density area adjoining a high-density area and thereby form an image with an appropriate density at all times irrespective of individual differences among different apparatus, external environmental changes and gradual deterioration over time of the apparatus.

In order to solve the problems described above, the invention provides an image forming apparatus in which image formation is carried out by an electrophotographic process based on a predetermined image forming condition, the image forming apparatus comprising:

an optical sensor for detecting densities of a toner patch image formed on a surface of a photosensitive body and outputting electric signals corresponding to the detected image densities; and a control unit for changing a set value of an image forming condition according to a degree of deflection in output signals of the optical sensor corresponding to detected densities of a rear edge part of the toner patch image.

In this configuration, the set value of the image forming condition is changed according to the degree of deflection in the optical sensor output signals representing the rear edge part of the toner patch image formed on the surface of the photosensitive body during the process control. When a decrease in image density occurs at the rear edge part of the toner patch image, a deflection is produced in the output signals of the optical sensor according to the degree of the decrease in image density. Hence, the degree of the decrease in image density that occurs at the rear edge part of the image is measured by the degree of deflection in output signals of the optical sensor. The set value of the image forming condition is changed so as not to produce a decrease in image density at the rear edge part of an image. The process control is ordinary processing performed by the image forming apparatus to set the image forming conditions in an image forming apparatus. Thus, without having to add new components to an image forming apparatus, it is possible to prevent decrease in image density at the rear edge part of an image.

In the invention it is preferable that the control unit compares the degree of deflection in the output signals of the optical sensor for the rear edge part of the toner patch image with a low-output side reference value of deflection and a high-output side reference value of deflection and changes the set value of the image forming condition only in a range between values of the image forming condition corresponding to the low-output side reference value of deflection and the high-output side reference value of deflection.

In this configuration, the set value of the image forming condition is changed according to the degree of deflection in the optical sensor output signals, in the range between values corresponding to the low-output side reference value of deflection and the high-output side reference value of deflection. Hence, the image forming condition is not changed excessively beyond the predetermined allowable range. This prevents decrease in image density at the rear edge part of an image without incurring an increase in cost and size of the apparatus due to increased capacities of constitutional devices which would result from an excess image forming condition, or without causing significant degradation of image quality.

In the invention it is preferable that the control unit increases or decreases a difference between a charged potential and a development potential on the surface of the photosensitive body according to the degree of deflection in the output signals of the optical sensor.

In this configuration, the difference between the charged potential and the development potential on the surface of the photosensitive body is set to decrease as the degree of deflection in output signals of the optical sensor that corresponds to the degree of the decrease in image density at the rear edge part of the toner patch image increases. Hence, by changing the difference between the charged potential and the development potential on the surface of the photosensitive body, the decrease in density at the rear edge part of an image can be prevented.

The control unit can change the difference between the charged potential and the development potential on the surface of the photosensitive body by controlling the grid voltage applied to the charger.

With this configuration, the difference between the charged potential and the development potential on the surface of the photosensitive body can be changed relatively easily and precisely to prevent the decrease in density at the rear edge part of an image by controlling the operation of the power supply device which supplies the grid voltage to the charger.

In the invention it is preferable that the control unit increases or decreases an quantity of exposure light applied to the surface of the photosensitive body according to the degree of deflection in the optical sensor output signals.

In this configuration, the quantity of the exposure light applied to the surface of the photosensitive body is set to increase as the degree of deflection in the output signals of the optical sensor that corresponds to the degree of the decrease in image density at the rear edge part of the toner patch image increases. Hence, changing the quantity of the exposure light applied to the photosensitive body surface can prevent decrease in density at the rear edge part of an image.

The control unit can change the quantity of the exposure light applied to the surface of the photosensitive body by controlling at least one of a drive power applied to the exposure light source, a PWM value of a drive pulse applied to the exposure light source, an exposure speed and an exposure light spot diameter.

With this configuration, the quantity of the exposure light applied to the surface of the photosensitive body can be changed relatively easily and precisely to prevent decrease in density at the rear edge part of an image by controlling the operation of the drive circuit that drives the exposure light source.

In the invention it is preferable that the control unit increases or decreases a quantity of discharge light applied to the surface of the photosensitive body according to the degree of deflection in the output signals of the optical sensor.

In this configuration, the quantity of the discharge light applied to the surface of the photosensitive body is set to increase as the degree of deflection in the output signals of the optical sensor that corresponds to the degree of the decrease in image density at the rear edge part of the toner patch image increases. Hence, the decrease in density at the rear edge part of an image can be prevented by changing the quantity of the discharge light applied to the surface of the photosensitive body.

The control unit can change the quantity of the discharge light applied to the surface of the photosensitive body by controlling the voltage applied to the discharge light source.

With this configuration, the quantity of the discharge light applied to the surface of the photosensitive body can be changed relatively easily and precisely to prevent the decrease in density at the rear edge part of an image by controlling the operation of the drive circuit that drives the discharge light source.

In the invention it is preferable that the control unit increases or decreases a speed of image development on the surface of the photosensitive body according to the degree of deflection in the optical sensor output signals.

In this configuration, the image development speed on the surface of the photosensitive body is set to decrease as the degree of deflection in the optical sensor output signals that corresponds to the degree of the decrease in image density at the rear edge part of the toner patch image increases. Hence, the density reduction at the rear edge part of an image can be prevented by changing the image development speed on the surface of the photosensitive body.

The control unit can change the quantity of the exposure light applied to the surface of the photosensitive body by controlling the rotation speed of the development roller.

In this configuration, the image development speed on the surface of the photosensitive body can be changed relatively easily and precisely to prevent the density reduction at the rear edge part of an image by controlling the operation of the drive circuit that drives the development roller.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1A:
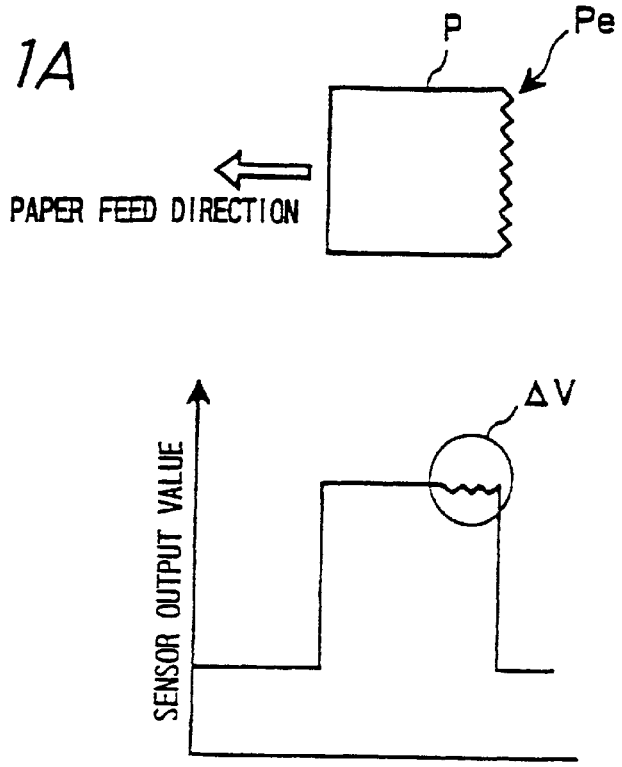
FIGS. 1A and 1B are diagrams showing a method of measuring an image loss level in the image forming apparatus according to an embodiment of the invention.

Now referring to the drawings, preferred embodiments of the invention are described below.

The image forming apparatus according to the embodiment of this invention performs the similar control to the one carried out during the process control to determine a condition for correcting an image density reduction that occurs at a rear edge part. For this purpose, the apparatus generates a toner patch image on the photosensitive body and reads the toner patch image by a reflection type optical sensor to detect an image density reduction at the rear edge part. The toner patch image formed here is an image that meets the condition for producing an image density reduction explained in FIGS. 14A, 14B and 15A–15C, i.e., an image in which a half-tone area is immediately followed by a background area and an image in which a low-density area is immediately followed by a high-density area. The detection of an image density reduction is done by the method explained by referring to FIGS. 1A and 1B.

Figure 1B:
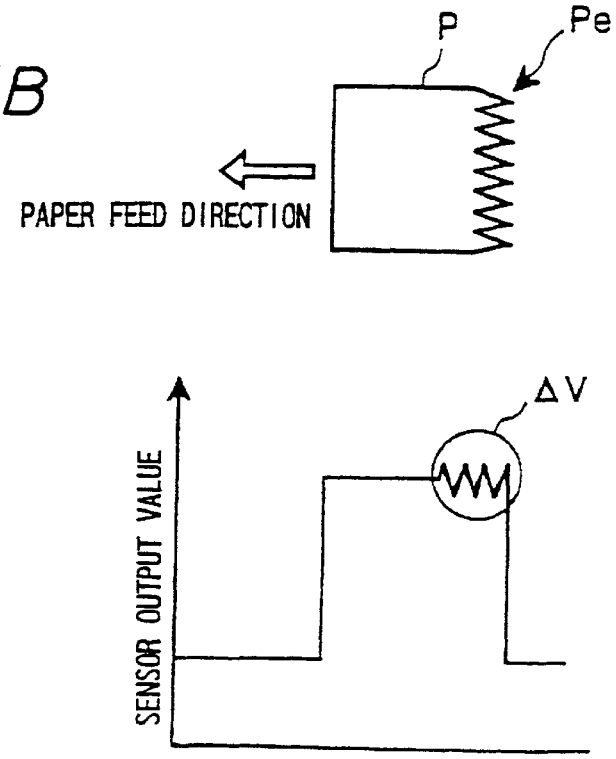

As shown in FIGS. 1A and 1B, when a partial image density reduction (image loss) Pe occurs in the toner patch image P, the output (sensor output) of the optical sensor that has read the toner patch image P exhibits a deflection. The amplitude ΔV of the sensor output deflection is small when the image loss Pe is small as shown in FIG. 1A and large when the image loss Pe is large as shown in FIG. 1B. Hence, measuring the amplitude ΔV of the sensor output deflection can detect a degree of the image loss (level of image loss).

With the image loss level detected in this way, the occurrence of the image loss is suppressed by changing image forming conditions, which include a difference (cleaning field) between the grid voltage applied to a charger that gives single polarity charges to the surface of the photosensitive body and the development bias applied to a developer that makes an electrostatic latent image formed over the surface of the photosensitive body visible, a light quantity of a laser scan unit (LSU) that radiates an exposure beam onto the surface of the photosensitive body to form an electrostatic latent image, a light quantity of a discharger that discharges residual charges remaining on the surface of the photosensitive body. after an image transfer process, or a circular velocity ratio between the photosensitive body and the development roller.

The range in which the image forming conditions are changed covers only an area of the image in which the image loss is likely to occur. This range is analyzed from the input image data, as in the configuration disclosed in JP-A 10-65920. A method for changing the image forming conditions in a correction range detected based on the input image data will be explained in the following.

Figure 2:
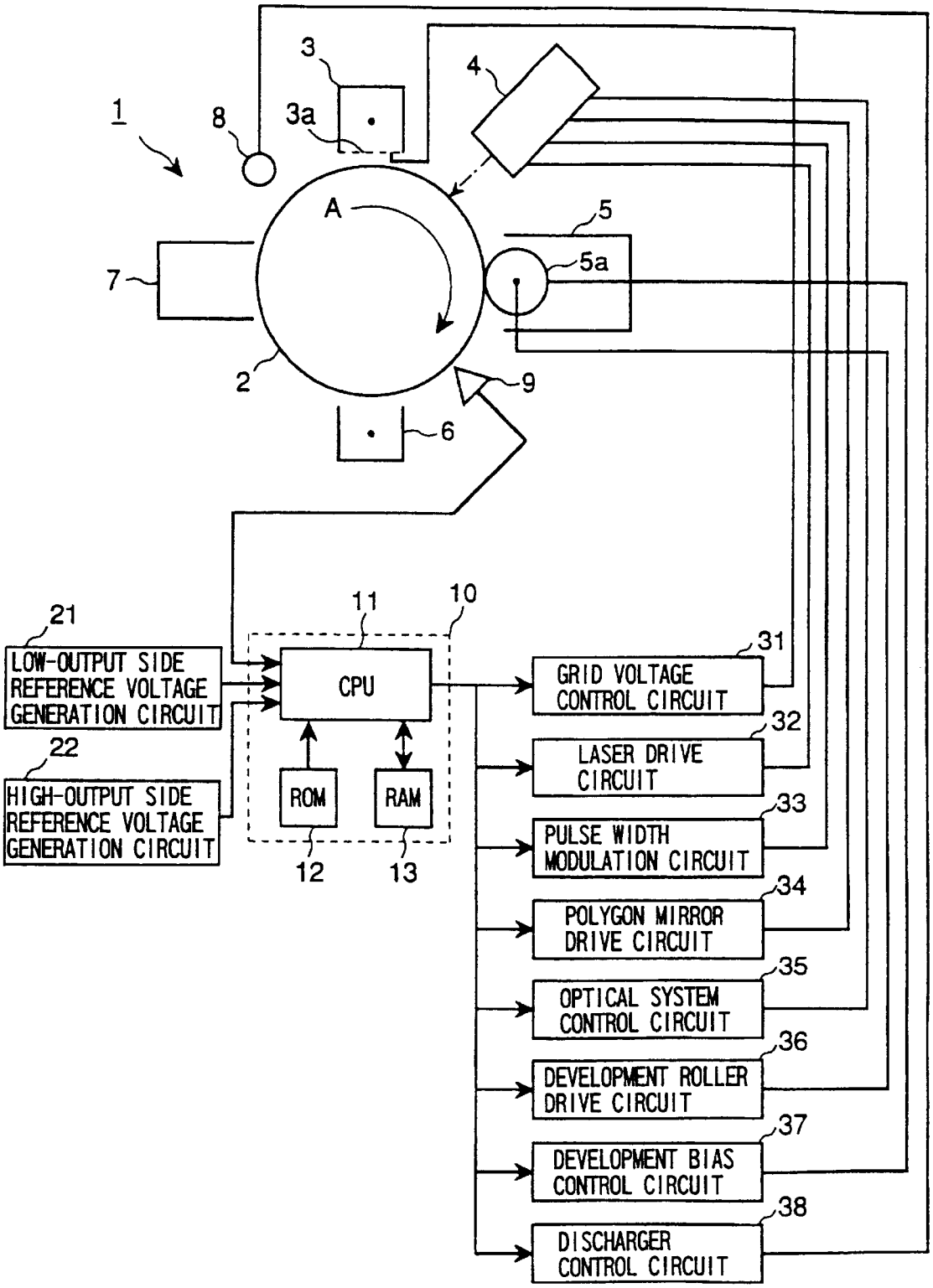
FIG. 2 is a block diagram showing configurations of an image forming process unit and a control unit in the image forming apparatus.

FIG. 2 is a block diagram showing the configuration of an image forming process unit and a control unit in the image forming apparatus according to the embodiment of the invention. The image forming process unit 1 in the image forming apparatus has a charger 3, a laser scan unit (LSU) 4, a development unit 5, an image transfer unit 6, a cleaner 7 and a discharger 8 arranged in that order around a photosensitive drum 2 which is supported rotatable in the direction of arrow A. The photosensitive drum 2 has a photosensitive layer formed over a circumferential surface of a conductive cylindrical base body of aluminum, for instance. The charger 3 produces a corona discharge through a grid 3*a* to apply electric charges of a predetermined polarity uniformly to the surface of the photosensitive drum 2. The LSU 4 has exposure optical system components therein, such as a semiconductor laser as a light source, a polygon mirror and an aperture, and radiates a laser beam onto the surface of the photosensitive drum 2 according to the image data to form an electrostatic latent image on the surface of the photosensitive drum 2 by the photoconductivity of the photosensitive layer.

The development unit 5 supplies toner to the surface of the photosensitive drum 2 through a development roller 5*a* to make the electrostatic latent image visible. The image transfer unit 6 generates a corona discharge with the paper from a paper feed unit not shown held between it and the surface of the photosensitive drum 2 and thereby transfers a toner image from the surface of the photosensitive drum 2 onto the surface of the paper. The paper that has received the toner image is then heated and pressed in a fixing device not shown, causing the toner image to be fused and fixed on the paper surface. The cleaner 7 removes toner remaining on the surface of the photosensitive drum 2 that has passed the position facing the image transfer unit 6. The discharger 8 radiates light onto the surface of the photosensitive drum 2 that has passed the position facing the image transfer unit 6 to remove residual charges.

Around the photosensitive drum 2 an optical sensor 9 is arranged between the development unit 5 and the image transfer unit 6. The optical sensor 9, during the process control executed to determine the image forming conditions, optically reads the toner patch image experimentally formed on the surface of the photosensitive drum 2 and outputs an electric signal as a sensor output representing a toner density of the toner patch image.

The control unit 10 of the image forming apparatus has a CPU 11 including a ROM 12 and a RAM 13 and performs an overall control on devices in the image forming apparatus including those making up the image forming process unit 1. The input side devices connected to the CPU 11 include a low-output side reference voltage generation circuit 21, a high-output side reference voltage generation circuit 22 and an optical sensor 9. The output side devices include a grid voltage control circuit 31, a laser drive circuit 32, a pulse width modulation circuit 33, a polygon mirror drive circuit 34, an optical system control circuit 35, a development roller drive circuit 36, a development bias control circuit 37, and a discharger drive circuit 38.

The low-output side reference voltage generation circuit 21 feeds to the CPU 11 a voltage value set as a threshold value Va for the low-output side of the sensor output described later. The high-output side reference voltage generation circuit 22 similarly feeds to the CPU 11 a voltage value set as a threshold value Vb for the high-output side of the sensor output. The CPU 11 compares the sensor output from the optical sensor 9 with the threshold values Va and Vb from the low-output side reference voltage generation circuit 21 and the high-output side reference voltage generation circuit 22, and outputs a target value data determined based on the result of this comparison to the output side devices.

The grid voltage control circuit 31 applies to the grid 3*a* of the charger 3 a grid voltage corresponding to the target value data output from the CPU 11. The laser drive circuit 32 drives a semiconductor laser in the LSU4 with a laser output corresponding to the target value data output from the CPU 11. The pulse width modulation circuit 33 applies to the semiconductor laser in the LSU 4 a drive pulse of a width corresponding to the target value data output from the CPU 11.

The polygon mirror drive circuit 34 rotates the polygon mirror in the LSU 4 at a rotation speed corresponding to the target value data output from the CPU 11. The optical system control circuit 35 controls an aperture area in the LSU 4 so as to form a spot diameter corresponding to the target value data output from the CPU 11. The development roller drive circuit 36 rotates the development roller 5*a* at a rotation speed corresponding to the target value data output from the CPU 11. The development bias control circuit 37 applies to the development roller 5*a* a development bias of a voltage value corresponding to the target value data output from the CPU 11. The discharger control circuit 38 applies to the discharger 8 a voltage corresponding to the target value data output from the CPU 11.

A. When Cleaning Field is Changed

Figure 3A:
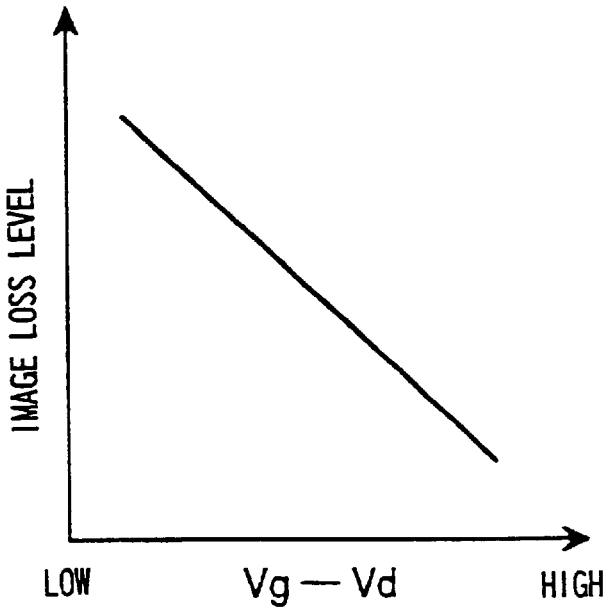
FIGS. 3A and 3B are diagrams showing a relation between differences between grid voltages and development biases and image loss levels in the image forming apparatus, and a relation between the differences and sensor outputs ΔV.
Figure 3B:
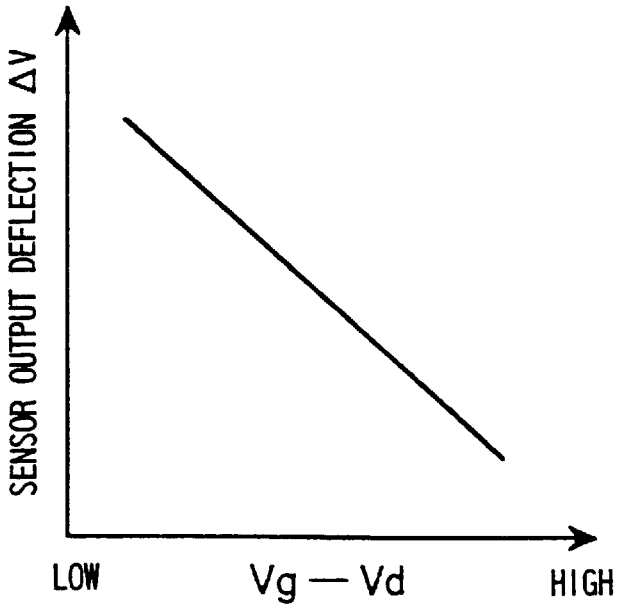

When the occurrence of image loss is to be eliminated by detecting a waveform change in the sensor output when the toner patch image is read by the optical sensor 9 used for the process control and by changing the difference (Vg−Vd) between the grid voltage Vg and the development bias voltage Vd, it is necessary to reduce the (Vg−Vd) as the image loss level increases, as shown in FIG. 3A. As explained in FIGS. 1A and 1B, the waveform deflection amplitude ΔV of the sensor output (sensor output deflection) is proportional to the image loss level in the toner patch image. Hence, the (Vg−Vd) corresponding to the image loss level can be realized by determining the target value that will reduce the difference (Vg−Vd) as the sensor output deflection ΔV increases, as shown in FIG. 3B.

Figure 4:
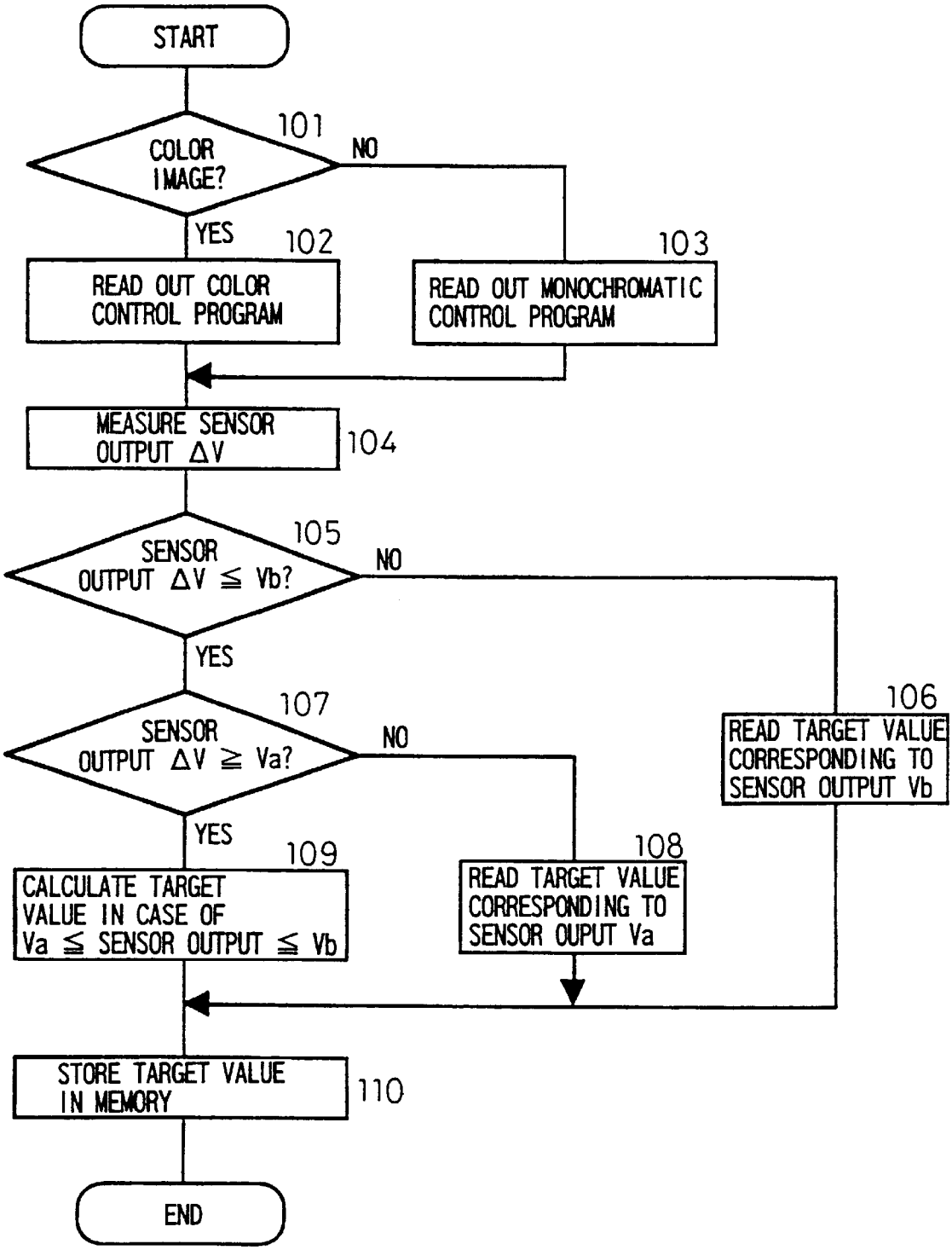
FIG. 4 is a flow chart showing a part of processing performed by the control unit of the image forming apparatus.

FIG. 4 is a flow chart showing a sequence of steps performed when changing the cleaning field in the image forming apparatus. The CPU 11 forming the control unit 10 of the image forming apparatus first checks whether the input image data is a color image or monochromatic image (101). This is because the correction state of the image forming condition varies depending on whether the image to be formed by the image forming apparatus is a color image or a monochromatic image and these images require different process programs. When the input image data is a color image, a color control program is read out (102); and when it is a monochromatic image, a monochromatic control program is read out (103).

Then, the CPU 11 forms a toner patch image on the surface of the photosensitive drum 2 and reads the sensor output deflection (hereinafter simply referred to as a sensor output) ΔV of the optical sensor 9 that measured the rear edge part of the toner patch image to detect the image loss level in the rear edge part of the toner patch image formed (104). The sensor output ΔV of the optical sensor 9 that corresponds to the image loss level in the rear edge part of the toner patch image is compared with the two threshold values Va and Vb (Va<Vb) (105, 107).

When the sensor output ΔV is more than the larger threshold Vb, or less than the smaller threshold Va, the CPU 11 sets a target value to the one that corresponds to the sensor output Vb or Va (106, 108). When the sensor output is equal to or more than the threshold value Va and equal to or less than the threshold value Vb, the CPU 11 sets a target value that linearly decreases as the sensor output increases (109). The CPU 11 stores the target value thus determined in a predetermined memory area of the RAM 13 (110).

The target value stored in the RAM 13 in the above process is read out by the CPU 11 during the image forming process executed later. In the image forming process, in a range of the input image data that is determined to develop an image loss, the CPU 11 performs the control to match the difference between the grid voltage Vg and the development bias voltage Vd to the target value.

Figure 5:
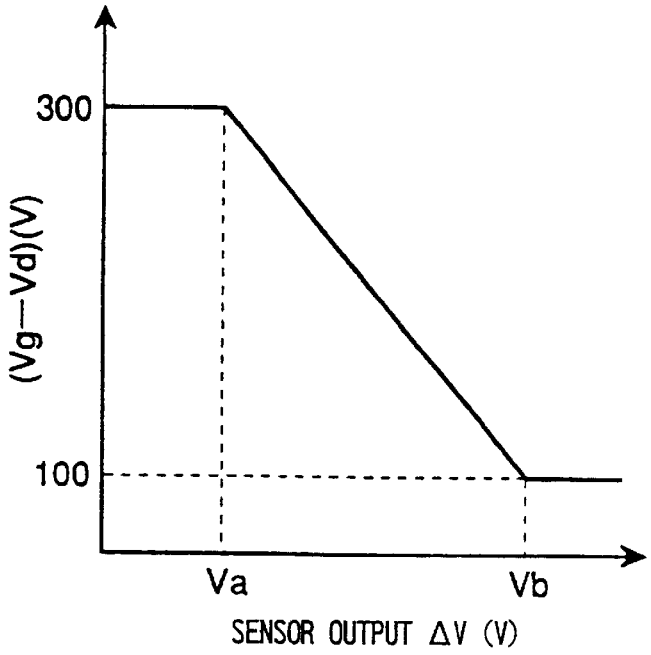
FIG. 5 is a diagram showing a relation between the sensor outputs ΔV and a target value of difference between grid voltage and development bias, the target value being set by the control unit.

In the above process, the low-output side threshold value Va of the sensor output is set to 0.5 V and the target value of (Vg−Vd) corresponding to the threshold value Va is set to 300 V, for example, as shown in FIG. 5. The high-output side threshold value Vb of the sensor output is set to 0.75 V and the target value of (Vg−Vd) corresponding to the threshold value Vb is set to 100 V. Normally, the grid voltage Vg applied to the charger is −500 V and the development bias voltage Vd is around −300 V.

In the image forming apparatus of this embodiment, the grid voltage Vg is changed via the grid voltage control circuit 31 to correct the value of (Vg−Vd). When the sensor output is between 0.5 V and 0.75 V, the value of (Vg−Vd) is changed between 300 V and 100 V. When the sensor output is less than 0.5 V, the (Vg−Vd) value is fixed to 300 V, the value that corresponds to the sensor output of 0.5 V. When the sensor output is higher than 0.75 V, the (Vg−Vd) value is fixed to 100 V, the value that corresponds to the sensor output of 0.75 V.

The reason for limiting the range in which to change the (Vg−Vd) value in this manner is that attempting to set the (Vg−Vd) value to an unlimitedly high value will result in an insufficient capacity of a high voltage power source and thus increase the burden of the circuit and that attempting to set the (Vg−Vd) value to an unlimitedly low value will result in a significant overlapping of images, degrading the image quality.

B. When LSU Light Quantity is Changed

Figure 6:
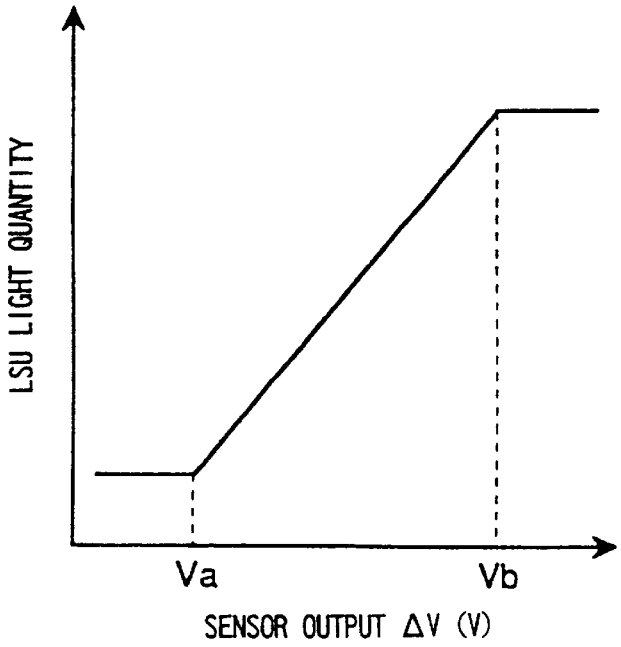
FIG. 6 is a diagram showing a relation between a target value of LSU light quantity set by the control unit and the sensor output ΔV.

When the LSU light quantity is to be changed based on the sensor output ΔV which is produced when the reflection type optical sensor 9 used for the process control read the toner patch image, the processing is carried out according to the procedure shown in FIG. 4 in a manner similar to that in which the cleaning field is changed. In this case, as shown in FIG. 6, the LSU light quantity corresponding to the sensor output ΔV is set as a target value, with the LSU light quantity corresponding to the low-output side threshold value Va of the sensor output ΔV set low and with the SLU light quantity corresponding to the high-output side threshold value Vb of the sensor output ΔV set high. In changing the LSU light quantity also, the range in which to change the LSU light quantity corresponding to the sensor output ΔV is limited.

Figure 7:
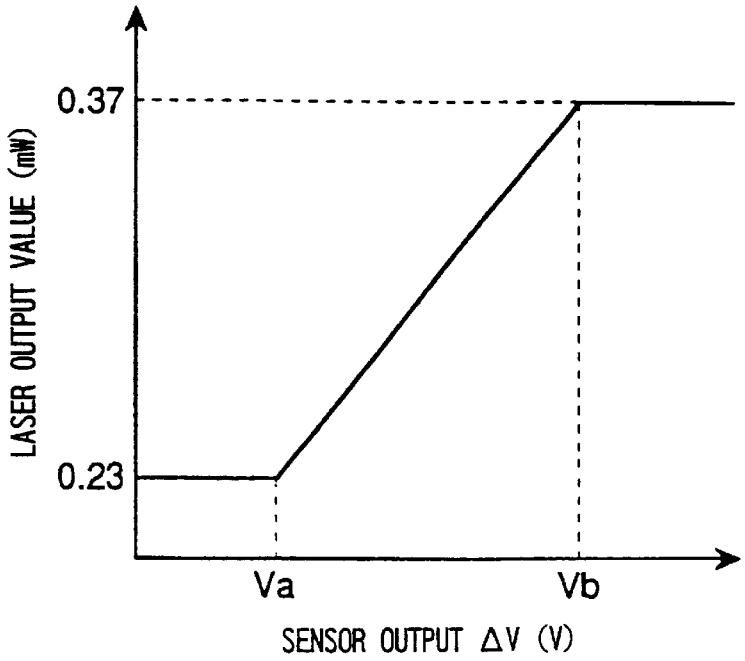
FIG. 7 is a diagram showing a relation between a target value of laser output set by the control unit and the sensor outputs ΔV.

Possible methods for changing the LSU light quantity include, for example, a control of a laser output value by the laser drive circuit 32, a control of a PWM (Pulse Width Modulation) value of the laser drive pulse by the pulse width modulation circuit 33, a control of a laser radiation time (rotation speed of polygon mirror) by the polygon mirror drive circuit 34, and a control of a spot diameter of a laser beam (area of an aperture disposed in the path of the laser beam) by the optical system control circuit 35.

a. In the case where the LSU light quantity is to be changed by changing the laser output value, when the sensor output ΔV is in the range of 0.5 V–0.75 V, the laser output value is changed between 0.23 mW and 0.37 mW, as shown in FIG. 7. When the sensor output ΔV is less than 0.5V, the laser output value is fixed to 0.23 mW, the value which corresponds to the sensor output ΔV of 0.5 V. When the sensor output ΔV is more than 0.75 V, the laser output value is fixed to 0.37 mW, the value which corresponds to the sensor output ΔV of 0.75 V.

Figure 8:
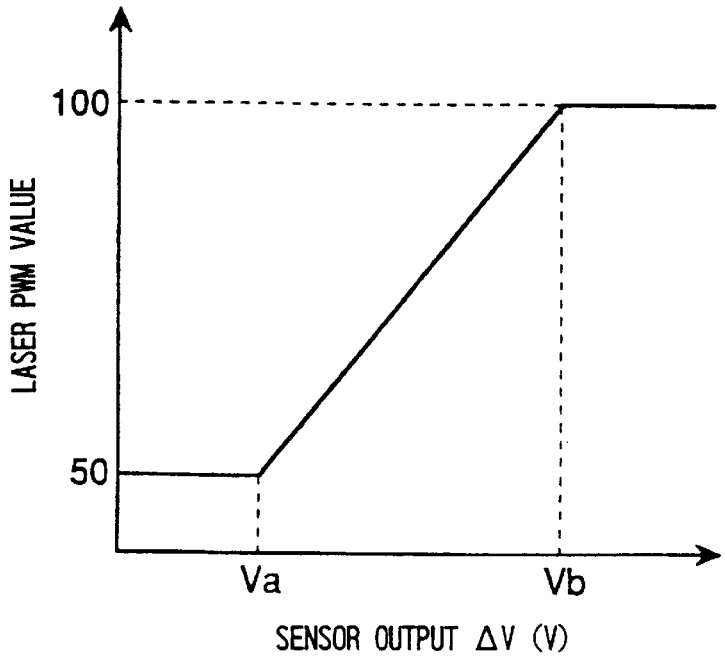
FIG. 8 is a diagram showing a relation between a target value of laser PWM set by the control unit and the sensor outputs ΔV.

The reason that the range in which to change the laser output value is limited in this manner is that attempting to set the laser output value to an excessively high value will degrade the image quality due to light fatigue of the photosensitive body and that attempting to set the laser output value to an excessively low value will result in a significant reduction in the image density and therefore a deteriorated image quality.

b. In the case where the LSU light quantity is to be changed by changing the laser PWM value, when the sensor output ΔV is in the range of 0.5 V–0.75 V, the laser PWM value is changed between 50 counts and 100 counts, as shown in FIG. 8. When the sensor output ΔV is less than 0.5 V, the laser PWM value is fixed to 50 counts, the value that corresponds to the sensor output ΔV of 0.5 V. When the sensor output ΔV is more than 0.75 V, the laser PWM value is fixed to 100 counts, the value that corresponds to the sensor output ΔV of 0.75 V.

Figure 9:
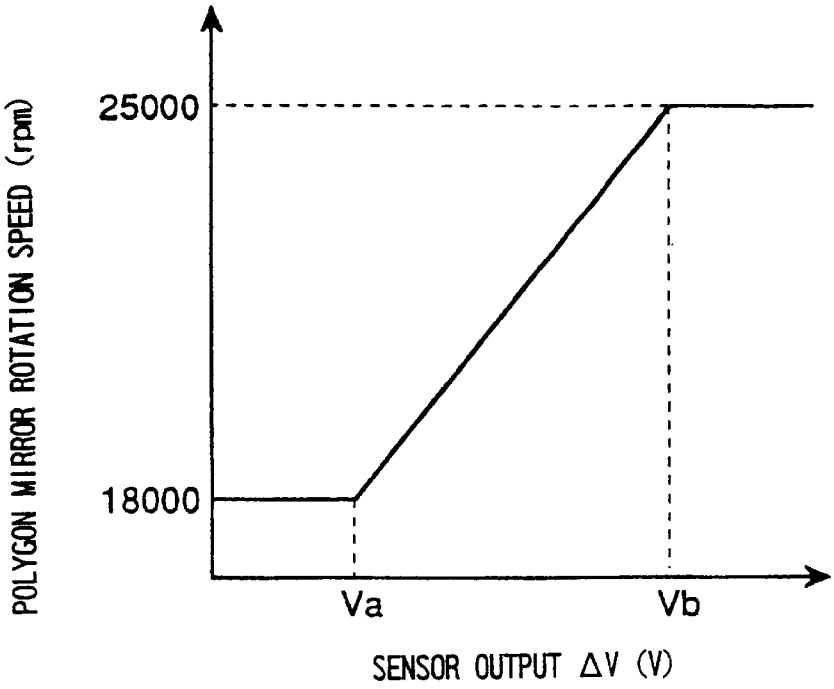
FIG. 9 is a diagram showing a relation between a target value of polygon mirror revolution set by the control unit and the sensor outputs ΔV.

The reason that the range in which to change the laser PWM value is limited in this manner is that attempting to set the laser PWM value to an excessively high value will degrade the image quality due to light fatigue of the photosensitive body and that attempting to set the laser PWM value to an excessively low value will result in a significant reduction in the image density and therefore a deteriorated image quality.

c. In the case where the LSU light quantity is to be changed by changing the laser radiation time (polygon mirror rotation speed), when the sensor output ΔV is in the range of 0.5 V–0.75 V, the polygon mirror rotation speed is changed between 18,000 rpm and 25,000 rpm, as shown in FIG. 9. When the sensor output ΔV is less than 0.5 V, the polygon mirror rotation speed is fixed to 18,000 rpm, the value that corresponds to the sensor output ΔV of 0.5 V. When the sensor output ΔV is more than 0.75 V, the polygon mirror rotation speed is fixed to 25,000 rpm, the value that corresponds to the sensor output ΔV of 0.75 V.

Figure 10:
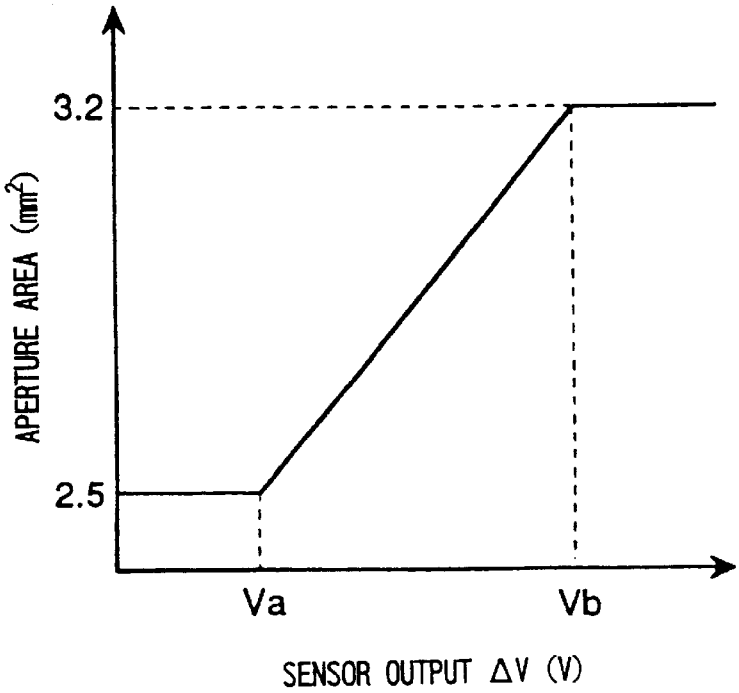
FIG. 10 is a diagram showing a target value of aperture area set by the control unit and the sensor output ΔV.

The reason that the range in which to change the polygon mirror rotation speed is limited in this manner is that attempting to set the polygon mirror rotation speed to an excessively high value will degrade the image quality due to light fatigue of the photosensitive body and increase the load of the rotation mechanism and that attempting to set the polygon mirror rotation speed to an excessively low value will result in a significant reduction in the image density and therefore a deteriorated image quality.

d. In the case where the LSU light quantity is to be changed by changing the spot diameter (aperture area) of a laser beam, when the sensor output ΔV is in the range of 0.5 V–0.75 V, the aperture area is changed between 2.5 $mm^2$ and 3.2 $mm^2$, as shown in FIG. 10. When the sensor output ΔV is less than 0.5 V, the aperture area is fixed to 2.5 $mm^2$, the value that corresponds to the sensor output ΔV of 0.5 V. When the sensor output ΔV is more than 0.75 V, the aperture area is fixed to 3.2 $mm^2$, the value that corresponds to the sensor output ΔV of 0.75 V.

The reason that the range in which to change the aperture area is limited in this manner is that attempting to set the aperture area to an excessively high value will degrade the image quality due to light fatigue of the photosensitive body and that attempting to set the aperture area to an excessively low value will result in a significant reduction in the image density and therefore a deteriorated image quality.

Any of the above processes a to d may be combined to change the LSU light quantity.

C. When Discharge Light Quantity is Changed

Figure 11:
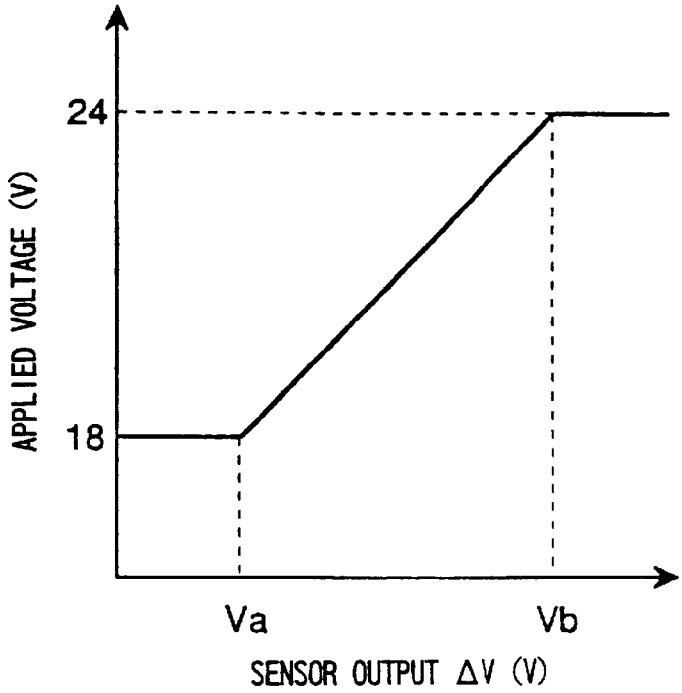
FIG. 11 is a diagram showing a relation between a target value of applied voltage for a discharger set by the control unit and the sensor outputs ΔV.

When the discharge light quantity is to be changed based on a waveform change in the sensor output ΔV which is produced when the reflection type optical sensor 9 used for the process control read the toner patch image, the processing is carried out according to the procedure shown in FIG. 4 in a manner similar to that in which the cleaning field is changed. In that case, as shown in FIG. 11, the discharge light quantity corresponding to the sensor output ΔV is set as a target value, with the discharge light quantity corresponding to the low-output side threshold value Va of the sensor output ΔV set low and with the discharge light quantity corresponding to the high-output side threshold value Vb of the sensor output ΔV set high. In changing the discharge light quantity also, the range in which to change the discharge light quantity corresponding to the sensor output ΔV is limited. The discharge light quantity may be changed by changing the voltage applied to the discharger.

To describe in more detail, when the sensor output ΔV is in the range of 0.5 V–0.75 V, the voltage applied to the discharger is changed between 18 V and 24 V, as shown in FIG. 11. When the sensor output ΔV is less than 0.5 V, the applied voltage is fixed to 18 V, the voltage that corresponds to the sensor output ΔV of 0.5 V. When the sensor output ΔV is more than 0.75 V, the applied voltage is fixed to 24 V, the voltage that corresponds to the sensor output ΔV of 0.75 V.

The reason that the range in which to change the voltage applied to the discharger is limited in this manner is that attempting to set the applied voltage to an excessively high value will degrade the image quality due to light fatigue of the photosensitive body and increase the power source capacity and that attempting to set the applied voltage to an excessively low value will result in a photosensitive body memory phenomenon in which a previous electrostatic latent image remains on the surface of the photosensitive body, thereby degrading the image quality.

Figure 12:
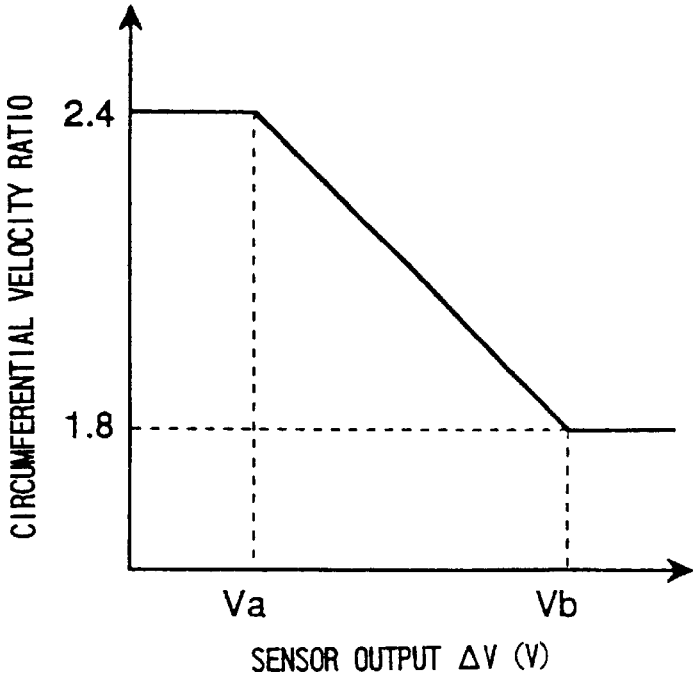
FIG. 12 is a diagram showing a relation between a target value of circumferential velocity ratio between the photosensitive drum and the development roller set by the control unit and the sensor outputs ΔV.
Figure 13A:
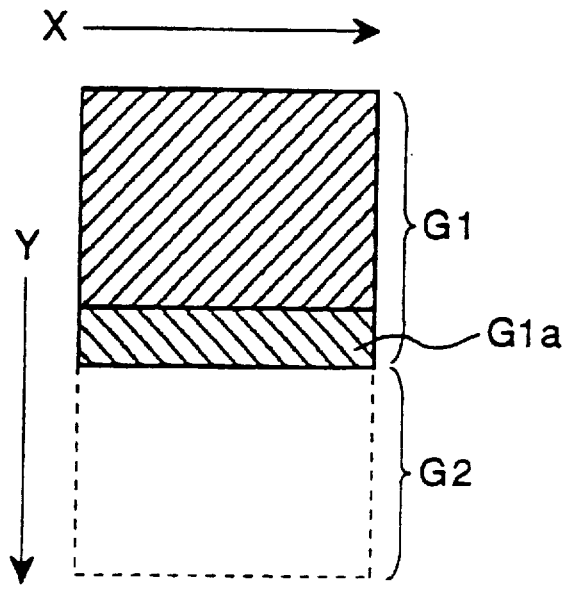
FIG. 13A PRIOR ART
FIGS. 13A and 13B are diagrams showing an image density reduction and an image loss that occur in a rear end part of an image in a conventional image forming apparatus.
Figure 13B:
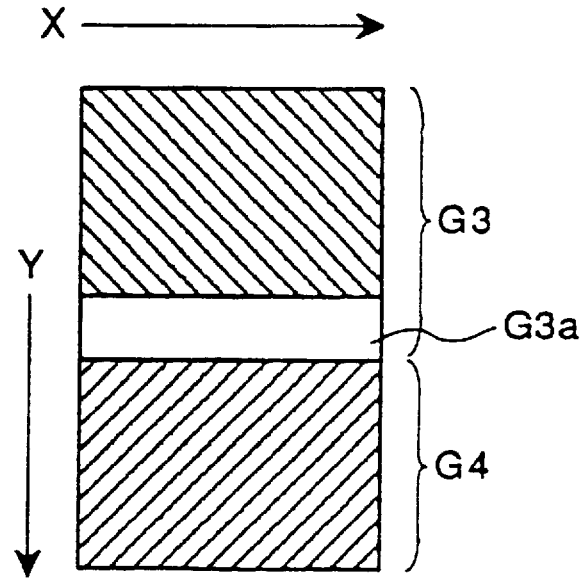
FIG. 13B PRIOR ART
Figure 14A:
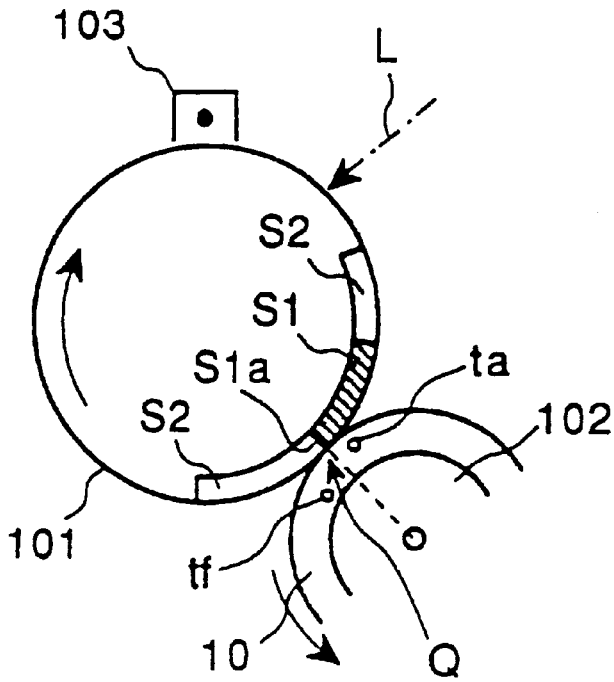
FIG.14A PRIOR ART
FIGS. 14A and 14B are diagrams showing how an image density reduction occurs at a rear end part of a half-tone area adjoining a background area.
Figure 14B:
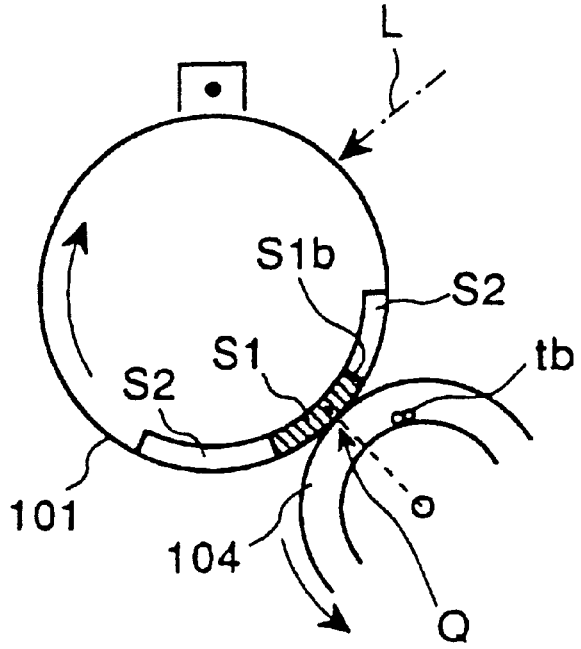
FIG.14B PRIOR ART
Figure 15A:
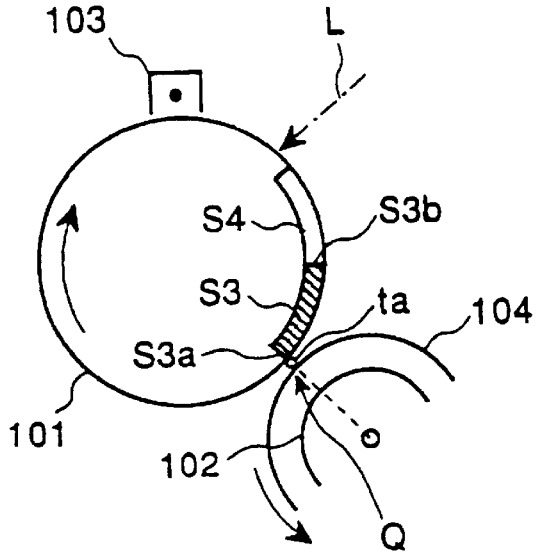
FIG. 15A PRIOR ART
FIGS. 15A–15C are diagrams showing how an image density reduction occurs at a rear end part of a low-density area adjoining a high-density area.
Figure 15B:
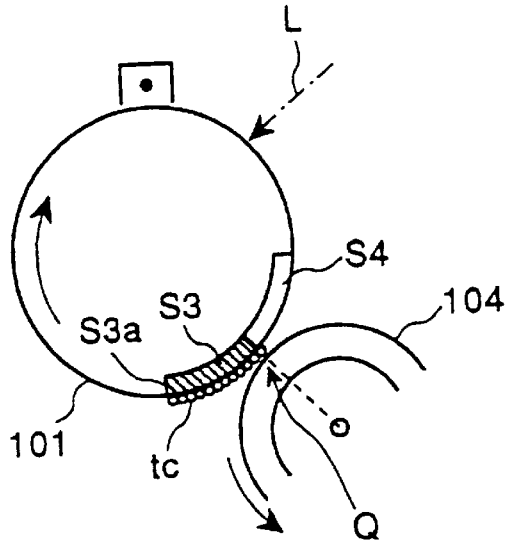
FIG. 15B PRIOR ART
Figure 15C:
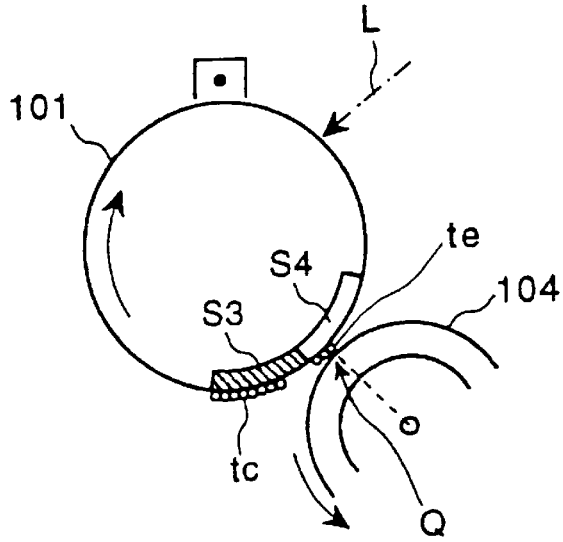
FIG. 15C PRIOR ART

D. When Circumferential Velocity Ratio between Photosensitive Body and Development Roller is Changed When the circumferential velocity ratio between the photosensitive body and the development roller is to be changed based on a waveform change in the sensor output ΔV which is produced when the reflection type optical sensor 9 used for the process control read the toner patch image, the processing is carried out according to the procedure shown in FIGS. 3A and 3B in a manner similar to that in which the cleaning field is changed. In that case, as shown in FIG. 12, the circumferential velocity ratio corresponding to the sensor output ΔV is set as a target value, with the circumferential velocity ratio corresponding to the low-output side threshold value Va of the sensor output ΔV set high and with the circumferential velocity ratio corresponding to the high-output side threshold value Vb of the sensor output ΔV set low. In changing the circumferential velocity ratio also between the photosensitive body and the development roller, the range in which to change the circumferential velocity ratio corresponding to the sensor output ΔV is limited. The circumferential velocity ratio between the photosensitive body and the development roller may be changed by changing the rotation speed of the development roller.

To describe in more detail, when the sensor output ΔV is in the range of 0.5 V–0. 75 V, the circumferential velocity ratio is changed between 2.4 and 1.8, as shown in FIG. 12. When the sensor output ΔV is less than 0.5 V, the circumferential velocity ratio is fixed to 2.4, the value that corresponds to the sensor output ΔV of 0.5 V. When the sensor output ΔV is more than 0.75 V, the circumferential velocity ratio is fixed to 1.8, the value that corresponds to the sensor output ΔV of 0.75 V.

The reason that the range in which to change the circumferential velocity ratio between the photosensitive body and the development roller is limited in this manner is that attempting to set the circumferential velocity ratio to an excessively high value by increasing the rotation speed of the development roller will increase mechanical stresses on the developer and reduce the thickness of the photosensitive layer on the surface of the photosensitive body and that attempting to set the circumferential velocity ratio to an excessively low value will result in the image density falling significantly short of the required level, degrading the image quality.

In the image forming apparatus according to the embodiment of the invention, the image forming conditions are determined based on the sensor output ΔV of the optical sensor 9 representing a rear end part of the toner patch image formed during the process control which develops a loss of image, and then the subsequent image forming process is executed according to the determined image forming conditions, as described above. This prevents a reduction in the image density and a loss of image in the rear end part of a half-tone area adjoining a background area or in the rear end part of a low-density area adjoining a high-density area, thus maintaining the image forming state in good condition.

The above processing can be performed simultaneously with the process control that is executed at a predetermined timing in the image forming apparatus. It can also be executed at other timings. Any of the above processes A–D may be combined for execution.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus in which image formation is carried out in an electrophotographic manner based on a predetermined image forming condition, the image forming apparatus comprising:

an optical sensor for detecting varying densities of a toner patch image in which a half-tone area is located immediately adjacent a background area and a low-density area is located immediately adjacent a high-density area formed on a surface of a photosensitive body and outputting electric signals corresponding to the detected image densities; and a control unit for changing a set value of an image forming condition according to a degree of deflection in output signals of the optical sensor corresponding to detected densities of a rear edge part of the toner patch image to form an image with an appropriate density at all times.

2. The image forming apparatus of claim 1, wherein the control unit increases or decreases a difference between a charged potential and a development potential on the surface of the photosensitive body according to the degree of deflection in the output signals of the optical sensor.

3. The image forming apparatus of claim 1, wherein the control unit increases or decreases a quantity of exposure light applied to the surface of the photosensitive body according to the degree of deflection in the optical sensor output signals.

4. The image forming apparatus of claim 1, wherein the control unit increases or decreases a quantity of discharge light applied to the surface of the photosensitive body according to the degree of deflection in the output signals of the optical sensor.

5. The image forming apparatus of claim 1, wherein the control unit increases or decreases a speed of image development on the surface of the photosensitive body according to the degree of deflection in the optical sensor output signals.

6. An image forming apparatus in which image formation is carried out in an electrophotographic manner based on a predetermined image forming condition, the image forming apparatus comprising:

an optical sensor for detecting densities of a toner patch image formed on a surface of a photosensitive body and outputting electric signals corresponding to the detected image densities; and a control unit for changing a set value of an image forming condition according to a degree of deflection in output signals of the optical sensor corresponding to detected densities of a rear edge part of the toner patch image;

wherein the control unit compares the degree of deflection in the output signals of the optical sensor for the rear edge part of the toner patch image with a low-output side reference value of deflection and a high-output side reference value of deflection and changes the set value of the image forming condition only in a range between values of the image forming condition corresponding to the low-output side reference value of deflection and the high-output side reference value of deflection.

7. The image forming apparatus of claim 6, wherein the control unit increases or decreases a difference between a charged potential and a development potential on the surface of the photosensitive body according to the degree of deflection in the output signals of the optical sensor.

8. The image forming apparatus of claim 6, wherein the control unit increases or decreases a quantity of exposure light applied to the surface of the photosensitive body according to the degree of deflection in the optical sensor output signals.

9. The image forming apparatus of claim 6, wherein the control unit increases or decreases a quantity of discharge light applied to the surface of the photosensitive body according to the degree of deflection in the output signals of the optical sensor.

10. The image forming apparatus of claim 6, wherein the control unit increases or decreases a speed of image development on the surface of the photosensitive body according to the degree of deflection in the optical sensor output signals.

* * * * *